US011643879B2

(12) United States Patent
Gao et al.

(10) Patent No.: US 11,643,879 B2
(45) Date of Patent: May 9, 2023

(54) NESTED DRILL BIT ASSEMBLY FOR DRILLING WITH CASING

(71) Applicant: Halliburton Energy Services, Inc., Houston, TX (US)

(72) Inventors: Bo Gao, Spring, TX (US); Cory Don Hillis, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 129 days.

(21) Appl. No.: 17/392,858

(22) Filed: Aug. 3, 2021

(65) Prior Publication Data

US 2023/0043864 A1 Feb. 9, 2023

(51) Int. Cl.

| | |
|---|---|
| ***E21B 10/62*** | (2006.01) |
| ***E21B 17/042*** | (2006.01) |
| ***E21B 33/16*** | (2006.01) |
| ***E21B 7/20*** | (2006.01) |

(52) U.S. Cl.

CPC ..... *E21B 10/62* (2013.01); *E21B 7/20* (2013.01); *E21B 17/042* (2013.01); *E21B 33/16* (2013.01); *E21B 2200/08* (2020.05)

(58) Field of Classification Search

CPC . E21B 7/20; E21B 7/208; E21B 7/207; E21B 10/62; E21B 10/42; E21B 10/43

See application file for complete search history.

(56) References Cited

U.S. PATENT DOCUMENTS

| | | | | |
|---|---|---|---|---|
| 3,181,631 | A * | 5/1965 | Nielsen | E21B 4/04 175/96 |
| 7,520,343 | B2 | 4/2009 | Hughes et al. | |
| 7,775,302 | B2 | 8/2010 | Warren | |
| 8,225,888 | B2 * | 7/2012 | Oldham | E21B 10/567 175/402 |
| 10,711,527 | B2 | 7/2020 | Lange et al. | |
| 2004/0118611 | A1 * | 6/2004 | Runia | E21B 4/02 175/57 |
| 2004/0238218 | A1 * | 12/2004 | Runia | E21B 21/10 175/57 |
| 2008/0078584 | A1 * | 4/2008 | Lyon | E21B 10/36 175/171 |
| 2013/0032333 | A1 | 2/2013 | Freese et al. | |
| 2013/0032545 | A1 | 2/2013 | Freese et al. | |
| 2018/0195348 | A1 * | 7/2018 | Lange | E21B 10/62 |

FOREIGN PATENT DOCUMENTS

| | | |
|---|---|---|
| EP | 1837481 | 3/2007 |

* cited by examiner

*Primary Examiner* — David Carroll
(74) *Attorney, Agent, or Firm* — Michael Jenney; C. Tumey Law Group PLLC

(57) ABSTRACT

A nested drill bit assembly is disclosed for drilling a wellbore, comprising a parent bit and at least one child bit nested within the parent bit. Each bit in the nested drill bit assembly may be driven by a respective casing that gets cemented in place as part of a drilling with casing system. The parent bit and child bit(s) may be rotated together, with the parent bit and child bit collectively defining a contiguous cutting profile for drilling an initial segment of the wellbore. A driver is then lowered into the casing for connection to the child bit to drill beyond the parent bit. The driver may be configured as a drive bit for drilling through material leftover from a cementing operation prior to connecting to the child bit.

20 Claims, 6 Drawing Sheets

NESTED DRILL BIT ASSEMBLY FOR DRILLING WITH CASING

BACKGROUND

Wells are constructed in subterranean formations in an effort to extract hydrocarbon fluids such as oil and gas. A wellbore may be drilled with a rotary drill bit mounted at the lower end of a drill string. The wellbore may then be reinforced with a metal casing, which typically involves tripping the drill string out of the wellbore before installing the casing. The wellbore may also be incrementally formed and cased in sections, which increases the number of trips required to complete the wellbore. Each trip into and out of the wellbore is an investment in time and money, which may impact the overall efficiency of constructing the well, and ultimately, the profitability of the well.

A more recently developed approach to constructing a wellbore is known alternatively as casing while drilling or drilling with casing (DWC). With DWC, the casing functionally serves as a tubular drill string during drilling, but is then cemented in place downhole as the casing. DWC thereby avoids having to trip out of the wellbore with a drill string and trip in with casing each time a section of casing is to be installed. However, DWC conventionally has its own limitations. For example, after the drill bit has reached its total depth (TD), the drill bit must be drilled out or abandoned. The former approach requires the drill bit to be drillable, which means that the hardness of its cutters is limited, and it may take much time to drill out the drill bit. The latter approach, wherein the drill bit is not drillable, generally means no further drilling can be done.

BRIEF DESCRIPTION OF THE DRAWINGS

These drawings illustrate certain aspects of some of the embodiments of the present disclosure and should not be used to limit or define the method.

DETAILED DESCRIPTION

This disclosure is directed, in part, to a nested drill bit assembly that allows for incrementally drilling each of a plurality of wellbore sections with corresponding bits of the nested drill bit assembly. The nested drill bit assembly includes an outermost drill bit that may be referred to in one or more examples as the parent bit, along with one or more child bits nested within the parent bit. The bits in the nested bit assembly may collectively define a primary cutting profile and are initially rotated together. After drilling to a first depth, a driver may be lowered into the wellbore and connected to a child bit, which is then used to drill beyond the parent bit. Various example configurations are also provided of the parent bit, child bit(s), drive bit, and mechanisms for connecting and transferring rotation and torque therebetween.

The disclosure is further directed, in part, to a drilling with casing (DWC) system and method that may incorporate the nested drill bit assembly. The parent bit may initially be rotated by a first casing secured to the parent bit, along with the child bit(s) nested therein, which simultaneously drives the casing into the wellbore as it is formed. After drilling to the first depth, the casing may be cemented in place by circulating a cement and cement plugs downhole and up through an annulus between the casing and wellbore. The driver may be configured as a drive bit having a cutting structure to drill through the cement, plugs, and other debris prior to connecting to the child bit. The drive bit may also be driven by an inner tubular, which may be another casing, which may likewise be driven into the wellbore as it is extended and then cemented in place. Any additional child bits may be used to similarly extend the wellbore.

As demonstrated below, the use of multiple nested bits allows for incrementally drilling to increased depth, and without having to trip out a first bit before tripping in with a next bit. This saves rig time and cost. Combining the nested drill bit assembly with the disclosed DWC techniques further reduces cost by effectively combining steps such as drilling, casing, and cementing that conventionally might be performed separately and with multiple separate trips.

Figure 1:
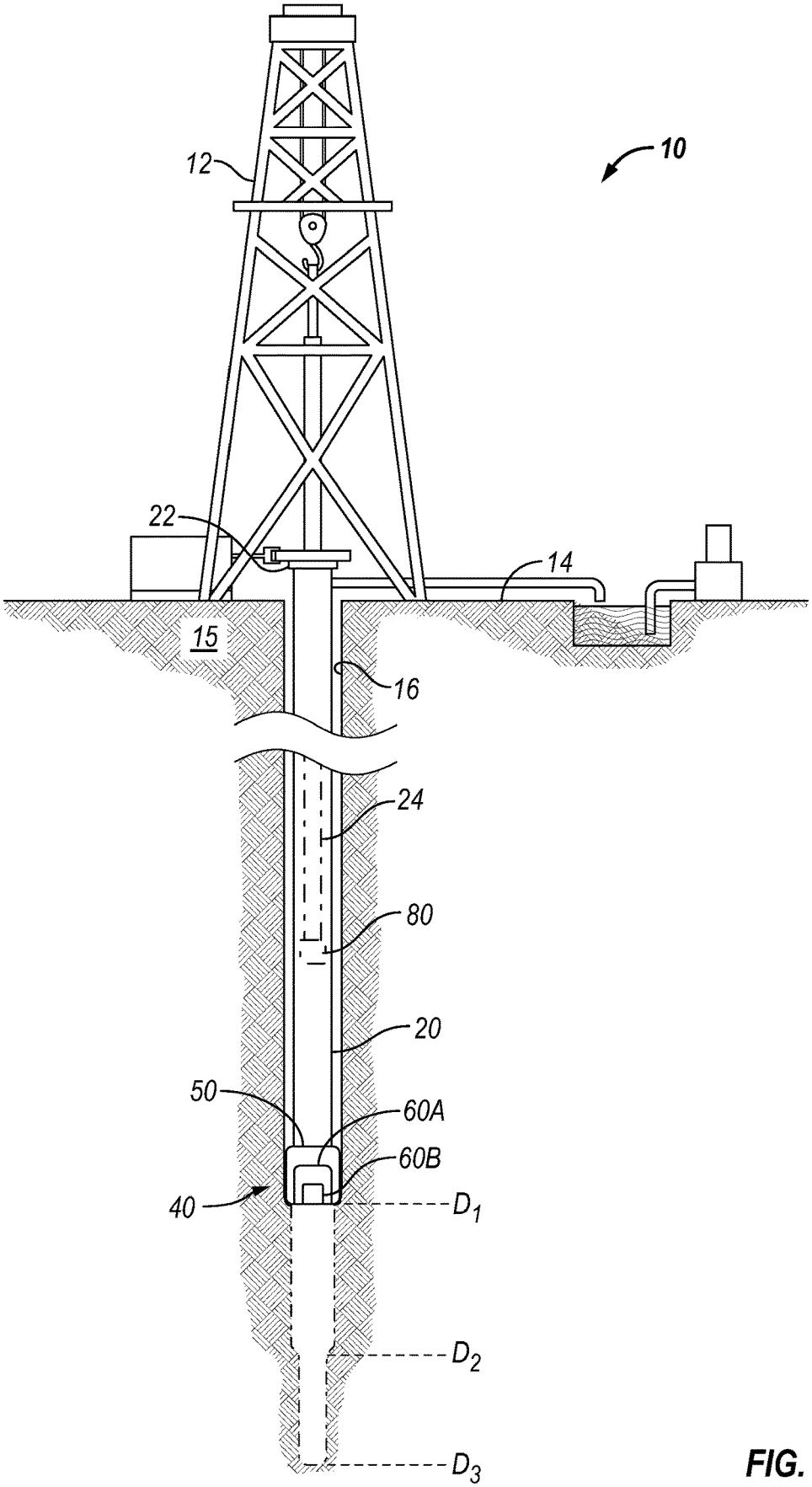
FIG. 1 is an elevation view of a drilling system in which a nested drill bit assembly and other aspects of the present disclosure may be implemented.

FIG. 1 is an elevation view of a drilling system 10 in which a nested drill bit assembly 40 and other aspects of the present disclosure may be implemented. This system 10 is a non-limiting example configuration for discussion purposes and is not to scale. Although depicted as a land-based drilling operation, those skilled in the art will also appreciate that aspects may be applied to offshore, subsea, or other kinds of drilling operations.

The system 10 includes a large support structure, such as a mast or derrick 12, erected at the wellsite at the location to be drilled. The derrick 12 may be part of a land-based rig as shown, or its equivalent on a jack up rig, floating rig, or offshore fixed structure. The derrick 12 helps support and guide well operations, such as drilling a wellbore 16 into an earthen formation 15, installing a casing 20, and cementing the casing 20 in place. The casing 20 is typically a long, metallic tubular structure that can be formed by progressively connecting individual casing segments end to end at the surface 14 of the wellsite to form a tubular casing string. The casing 20 is used to reinforce the wellbore 16 and also functions in DWC as a drill string for driving rotation of one or more drill bits included with the nested drill bit assembly 40. For example, the casing 20 itself may be suspended from the derrick 12 and rotated, such as by a top drive 22, which in turn will rotate one or more drill bits of the nested drill bit assembly 40. As the casing 20 is rotated to drive rotation of the drill bit assembly 40 in order to form one or more segments of the wellbore 16. As the wellbore 16 is drilled, the casing 20 is thereby advanced into the wellbore 16, where it will be cemented in place at a desired depth.

The nested drill bit assembly 40 according to this disclosure includes an outer (parent) drill bit (i.e., parent bit) 50 and at least one child drill bit (i.e., child bit) nested within the parent drill bit 50. To illustrate an example of multiple nested drill bits having more than one child bit, FIG. 1 shows two child bits, namely, a first child bit 60A nested with the parent bit 50 and a second child bit 60B nested within the first child bit 60. There is no express upper limit on the number of nested drill bits that may be included with the nested drill bit assembly 40, although that number may be practically limited by various parameters such as the overall size and outer diameter (OD) of the drill bit assembly 40, the desired total depth of the wellbore 16, the individual depths to which each nested drill bit is expected to drill, and size and design constraints to achieve any performance requirements of each of the nested bits.

The system 10 further includes at least one driver 80 to connect to the child bit(s) and drive rotation of the child bit(s) to drill beyond the parent bit 50. The driver 80 is not initially included when drilling with the nested drill bit assembly 40 and drilling with the parent bit 50. Rather, the driver 80 is configured (e.g., appropriately sized) so it may be lowered down the casing 20 on a second, inner tubular member (e.g., another casing) 24 to connect to one of the child bits 60A, 60B after the parent bit 50 has reached a first depth D1 and the casing 20 has been installed. The driver 80 may be alternately referred to as the drive bit 80 in this example because, as discussed further below, it is additionally configured to drill out material in the casing 20, such as residual material from a cementing operation, prior to connection with the child bit.

The nested drill bit assembly 40, including the parent bit 50 and the at least one child bit 60A, 60B nested therein, are initially all rotated together by the casing 20 to drill the first part of the wellbore 16 extending from the surface 14 of the wellsite to a first depth D1. Thus, the wellbore 16 may be drilled to the first depth D1 by rotating the entire nested drill bit assembly 40 including the parent bit 50 and the child bits 60A, 60B nested therein. The casing 20 may then remain in place to reinforce the wellbore from the surface 14 to depth D1.

The wellbore 16 may then be extended to a second depth D2 by lowering the drive bit 80 into the casing 20 on the second, inner tubular 24, connecting the drive bit 80 to the first child bit 60A, and using the inner tubular 24 to drive rotation of the first child bit 60A together with the second child bit 60B. The inner tubular 24 may function as a drill string to drive rotation of the drive bit 80 and the connected child bit, and also as a casing that will be used to reinforce the wellbore 16 from depth D1 to depth D2. The wellbore 16 may then be drilled to a third depth D3 by again lowering the drive bit 80 (which may be the same or a different drive bit) into the wellbore 16 on another tubular (e.g., a third casing), connecting to the second child bit 60B and using the third tubular to drive rotation of the second child bit 60B. After drilling to each depth, D1, D2, and D3, the respective casing may be cemented in place. The drive bit 80 may include a cutting structure configured for drilling out any cement or cement plugs that may remain after cementing the most recent casing string in place.

Figure 2:
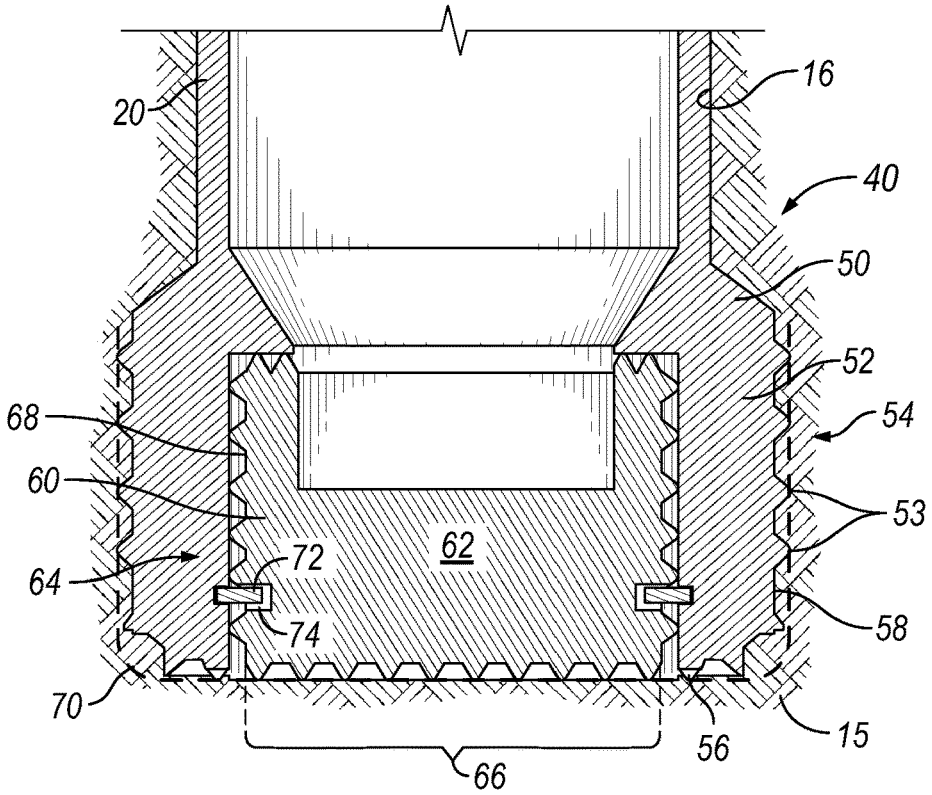
FIG. 2 is a sectional side view of the nested drill bit assembly according to an example configuration having one child bit nested within the parent bit.

FIG. 2 is a sectional side view of the nested drill bit assembly 40 according to a specific example configuration having one child bit 60 nested within the parent bit 50. The parent bit 50 includes a bit body (i.e., the parent bit body) 52 securable to the casing 20 for driving rotation of the parent bit 50 with the casing 20. The parent bit 50 also includes a cutting structure (i.e., the parent cutting structure) 54 disposed along an exterior of the parent bit body 52 for engaging the earthen formation 15 while drilling. The parent cutting structure 54 extends along the parent bit body 52 from a leading end or nose 56 to a lateral portion 58, which may be or include an outer diameter of the parent bit body 52. The child bit 60 likewise includes a bit body (i.e., the child bit body) 62 and a child cutting structure 64 secured to the child bit body 62. The child cutting structure 64 extends along the child bit body 62 from a leading end or nose 66 of the child bit body 62 to a lateral portion 68 of the child bit body 62. The nose 66 of the child bit 60 is contiguous with the parent cutting structure 54 at the nose 56 of the parent bit 50 and is thereby exposed to the formation 15. The lateral portion 68 of the child cutting structure 64 is internal to the parent bit body 52 and is not exposed to the earthen formation 15 while the child bit 60 is nested within the parent bit 50.

Thus, the parent cutting structure 54 together with a portion (in this case, the nose 66) of the child cutting structure 64 form a contiguous primary cutting profile generally indicated at 70. The contiguous cutting profile 70 may be comparable to the cutting profile of a monolithic drill bit, in that despite being comprised of cutting structures of multiple bits, the cutting profile is configured for drilling a portion of a wellbore as though the profile were defined by a monolithic drill bit. In a related aspect, the contiguous cutting profile 70 is continuous from the outer, parent cutting structure 54 to the portion of the child cutting structure 64 along the nose 66 of the child bit 60 without any appreciable vertical separation as the cutting profile 70 transitions from one to the other. The spacing between cutters along the primary cutting profile 70 may also be substantially uniformly spaced as well, similar to how such cutters might be spaced on a monolithic drill bit. Thus, the cutting structures from both the parent bit 50 and child bit 60 along the primary cutting profile 70 are rotated together and used to drill the wellbore 16 to the first depth D1. In other embodiments having one or more additional child bits (e.g., the second child bit 60B of FIG. 1), the one or more additional child bits could also include a cutting structure, a portion of which forms a contiguous primary cutting profile with at least a portion of the parent bit and the other child bit(s).

Any suitable cutting structures may be used for the parent bit 50 and child bit 60 capable of cutting, shearing, abrading, or otherwise disintegrating the earthen formation 15. The parent cutting structure 54 and/or the child cutting structure 64 may include a plurality of discrete cutters 53 spaced apart on the respective bit bodies. Examples of discrete cutters include but are not limited to polycrystalline diamond compact (PDC), which may have polycrystalline diamond cutting elements on a tungsten carbide substrate, carbide inserts, abrasive inserts, or other suitable hard and resilient elements for cutting, shearing, abrading, or otherwise disintegrating or destroying the earthen formation as a result of being rotated against the earthen formation 15. Alternatively, the parent cutting structure 54 and/or the child cutting structure 64 may be a continuous cutting structure, rather than separate and discrete cutters, formed on the respective bit bodies 52, 62.

The child bit 60 is releasably coupled to the parent bit 50 so that the child bit 60 remains nested within the parent bit 50 while drilling with the parent bit 50. One or more features may be provided to axially and/or rotationally constrain the child bit 60 with respect to the parent bit 50. In the example of FIG. 2, a shear member, embodied by way of example as a plurality of shear pins 72, constrains the child bit 60 at least axially. The shear pins 72 provide interference between the parent and child and require at least a threshold level of axial force on the child bit 60 to shear the shear pins 72. In the example of FIG. 2, the shear pins 72 ride in an annular groove 74, defined in this example on the child bit 60 allowing relative rotation between the child bit 60 and parent bit 50. An annular groove may alternately be defined by the parent bit 50 or cooperatively by the parent bit 50 and child bit 60, with the shear pin(s) or other shear members disposed therein.

Figure 3:
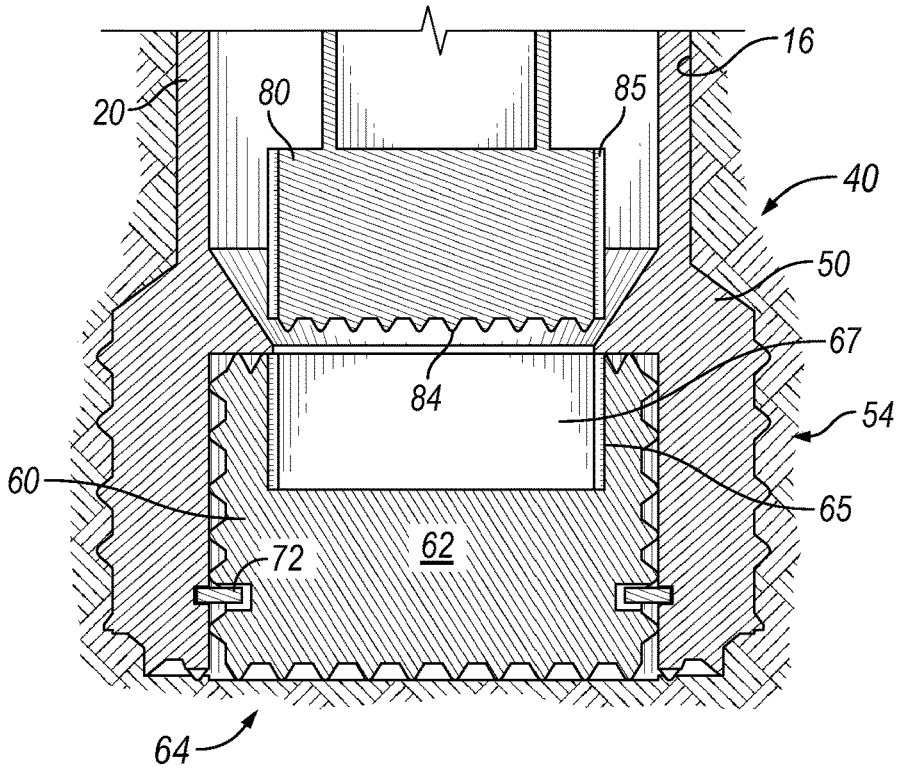
FIG. 3 is a sectional side view of the driver drill bit lowered into the casing above the nested drill bit assembly of FIG. 2.

FIG. 3 is a sectional side view of the driver drill bit (i.e., drive bit) 80 lowered into the casing 20 above the nested drill bit assembly 40 of FIG. 2. The child bit 60 includes a cavity 67 for receiving the drive bit 80. The drive bit 80 is lowered downhole into the casing 20 on the second, inner tubular 24, which may also function as another casing string. The drive bit 80 is a driver in that after releasing the child bit 60 from the parent bit 50 it may drive rotation of the child bit 60 to extend the wellbore beyond the parent bit 50. The drive bit 80 in this example is also, more specifically, a drive bit, in that the driver includes its own cutting structure (i.e., drive cutting structure) 84 disposed on a leading (lower) end of a drive bit body 82. The drive cutting structure 84 is configured to drill out any material, such as cement or cement plugs left over from a cementing operation to cement the casing 20 in place, as further discussed below.

Any suitable connection type that allows the drive bit 80 to be connected to the child bit 60 downhole and that allows axial force and torque transfer from the drive bit 80 to the child bit 60. In the example of FIG. 3, the connector includes a connector portion 85 on the drive bit 80 configured for connecting with a connector portion 65 on an interior cavity 67 of the child bit 60. More particularly, for example, the connector portion 65 of the child bit 60 may comprise a threaded member, and the connector portion 85 on the drive bit 80 may comprise another threaded member configured for threadably engaging the threaded member on the child bit 60, so that the drive bit 80 may be connected to the child bit 60 by rotation of the drive bit 80 with respect to the child bit 60. To facilitate making up this threaded connection between the drive bit 80 and child bit 60, the child bit 60 may be initially held using one or more shear members, e.g., one or more of the pins 72 or other pins, to resist relative rotation between the parent bit 50 and child bit 60 during make-up, and which shear after make-up. Non-limiting examples of other connections between the drive bit 80 and child bit 60 may include a splined connection, a collet connection, and/or an L-shaped slot with a pin that rides in the slot to provide axial and rotational constraints between the child bit 60 and drive bit 80. Industry standard and/or proprietary threads may also be used for this connection.

Figure 4:
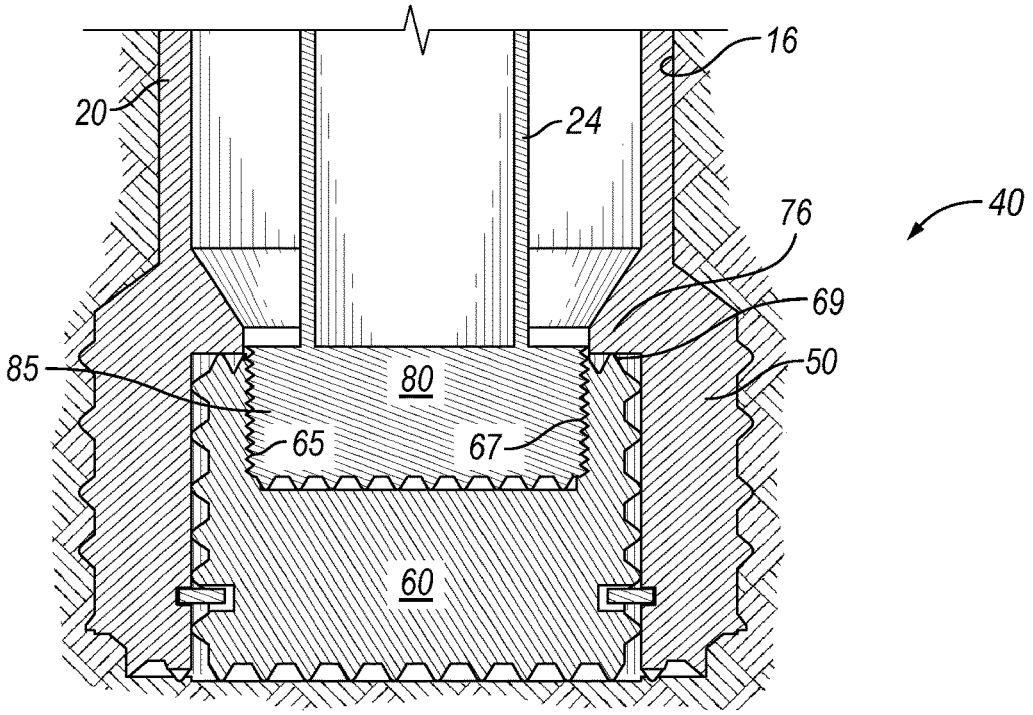
FIG. 4 is a sectional side view of the drive bit having been received into the cavity of the child bit and connected thereto.

FIG. 4 is a sectional side view of the drive bit 80 having been received into the cavity 67 of the child bit 60 and connected thereto. The connector portions 65, 85 on the child bit 60 and drive bit 80 are threaded members that have been threadably engaged, such as by rotation of the drive bit 80 with respect to the child bit 60. The thread orientation can be configured so that torque applied to drive the child bit 60 in the intended rotational direction during drilling will tend to maintain and not loosen this threaded connection. Once connected, the drive bit 80 may be used to release the child bit 60 from the parent bit 50, such as by applying a downward force through the inner tubing string 24 to shear the inner shearing shear pins 72 or other shear member. The connection may then be used to drive rotation and axial force via the inner tubing string 24 through the drive bit 80 to the child bit 60, for drilling beyond the parent bit 50 using the child bit 60.

The threaded connection also allows for pulling up on the child bit via the inner tubing string 24. In this embodiment, a shoulder 76 is included on the parent bit body 52 to initially limit upward movement of the child bit 60 with respect to the parent bit 50, and in particular, to help prevent the child bit 60 from unintentionally coming up out of the parent bit 50, such as when tripping the nested drill bit assembly 40 downhole or drilling with the parent bit 50 and child bit 60 together. However, the cutting structure of the child bit 60 includes a rear-facing cutting structure portion 69 configured to drill out the shoulder 76 to subsequently allow the child bit body to be retrieved axially up out of the parent bit body 50. The shoulder 76 and rear-facing cutting portion 69 may be selected to initially provide sufficient retention for the child bit 60 and for the shoulder 76 to be readily drillable by the rear-facing cutting portion 69. For example, a soft metallic structural material such as aluminum for the shoulder 76 may provide sufficient retention yet be sufficiently drillable. An upward force may be applied to the inner tubing string 24 during rotation of the tubing string to drill out the shoulder 76 using the rear-facing cutting portion 69.

Torque may be transferred from the parent bit 50 to the child bit 60, so that the child cutting structure 64 moves with the parent cutting structure 54 while drilling with the nested drill bit assembly 40. This torque transfer may be accomplished in a variety of ways, of which a few non-limiting examples are provided. In one example, a one-way transmission may be provided anywhere along an interface between the parent bit 50 and child bit 60. The one-way transmission may allow relative rotation between the parent bit 50 and drive bit 60 in one direction so that while drilling with the parent (outer) drill bit 50, the parent bit 50 transfer torque to the child bit 50, but while subsequently drilling with the child bit, the child bit 60 is allowed to rotate freely with respect to the parent bit 50. In another example, the one-way transmission may be omitted, and the shear pins 72 or other shear members could instead be used to both axially and rotationally constrain the child bit 60 within the parent bit 50 by omitting the annular groove 74. The shear pins 72 may provide sufficient strength to transfer both axial force and torque from the parent bit 50 to child bit 60 while drilling with the parent bit 50. Once the drive bit 80 is coupled to the child bit 60, a force may be applied to then shear the shear pins 72 via the inner tubular 24 to free the child bit 60 from the parent bit 50 to allow relative rotation therebetween so that the child bit 60 may be used to drill past the parent bit 50.

Figure 5:
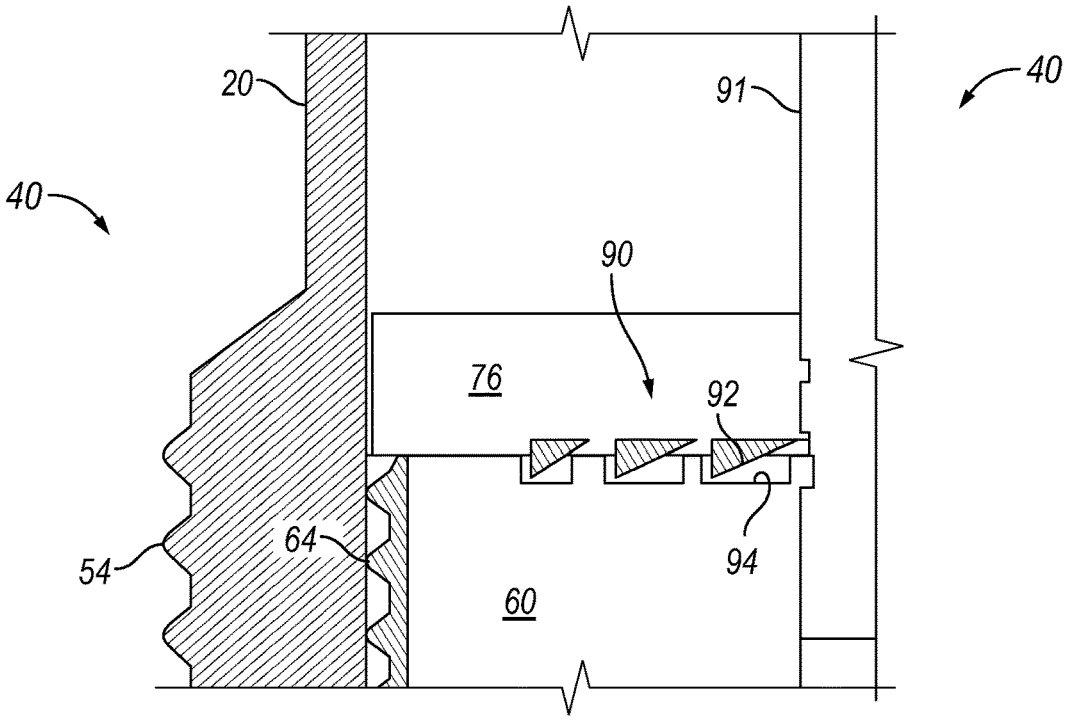
FIG. 5 is partially sectioned view of the nested drill bit assembly schematically illustrating an example of a one-way transmission between the parent bit and child bit.

FIG. 5 is partially sectioned view of the nested drill bit assembly 40 schematically illustrating an example of a one-way transmission 90 between the parent bit 50 and child bit 60. The transmission 90 comprises a plurality of pawls 92 circumferentially spaced along the shoulder 76 of the parent bit 50. The pawls 92 are spring-biased into recesses 94 circumferentially arranged on the child bit 60. (Another arrangement could alternatively provide pawls on the child bit biased into recesses on the parent bit.) The pawls 92 are angled to engage the child bit 50 during right-hand rotation of the parent bit 50, but move inwardly to allow relative rotation between the child bit 60 and parent bit 50 in the opposite rotational direction. The one-way transmission 90 thereby allows for transfer of a torque T (in this case, a right-hand torque) about a bit axis 91 from the parent bit 50 to the child bit 60 while the parent bit 50 is driven by the casing 20, so that the child cutting structure 64 rotates along with the parent cutting structure 54. The one-way transmission 90 allows relative rotation between the child bit 60 and parent bit 50 when the child bit 60 is later driven by the drive bit.

Figure 6:
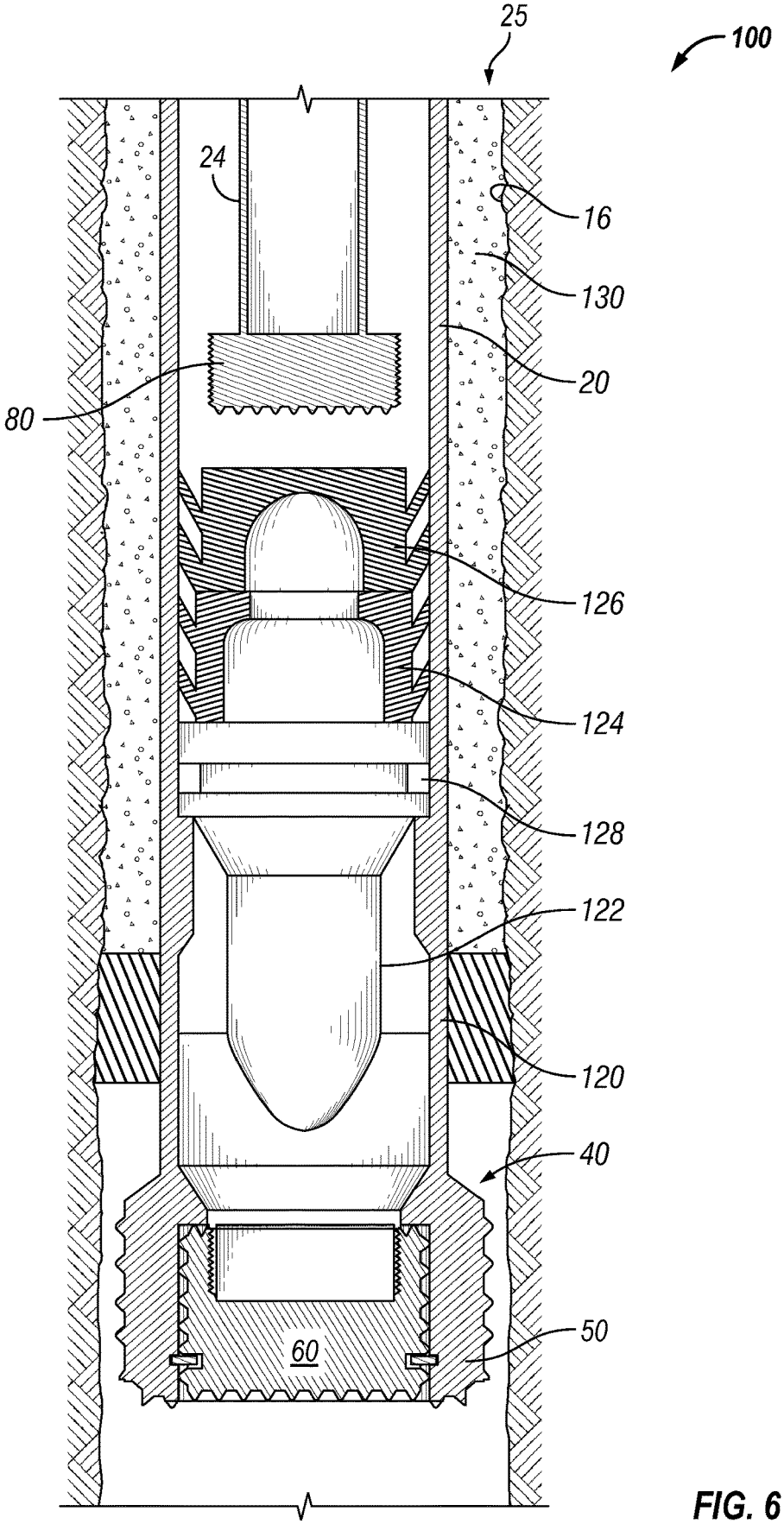
FIG. 6 is a side view of a DWC system including a multi-stage cementer according to an example configuration.
Figure 7:
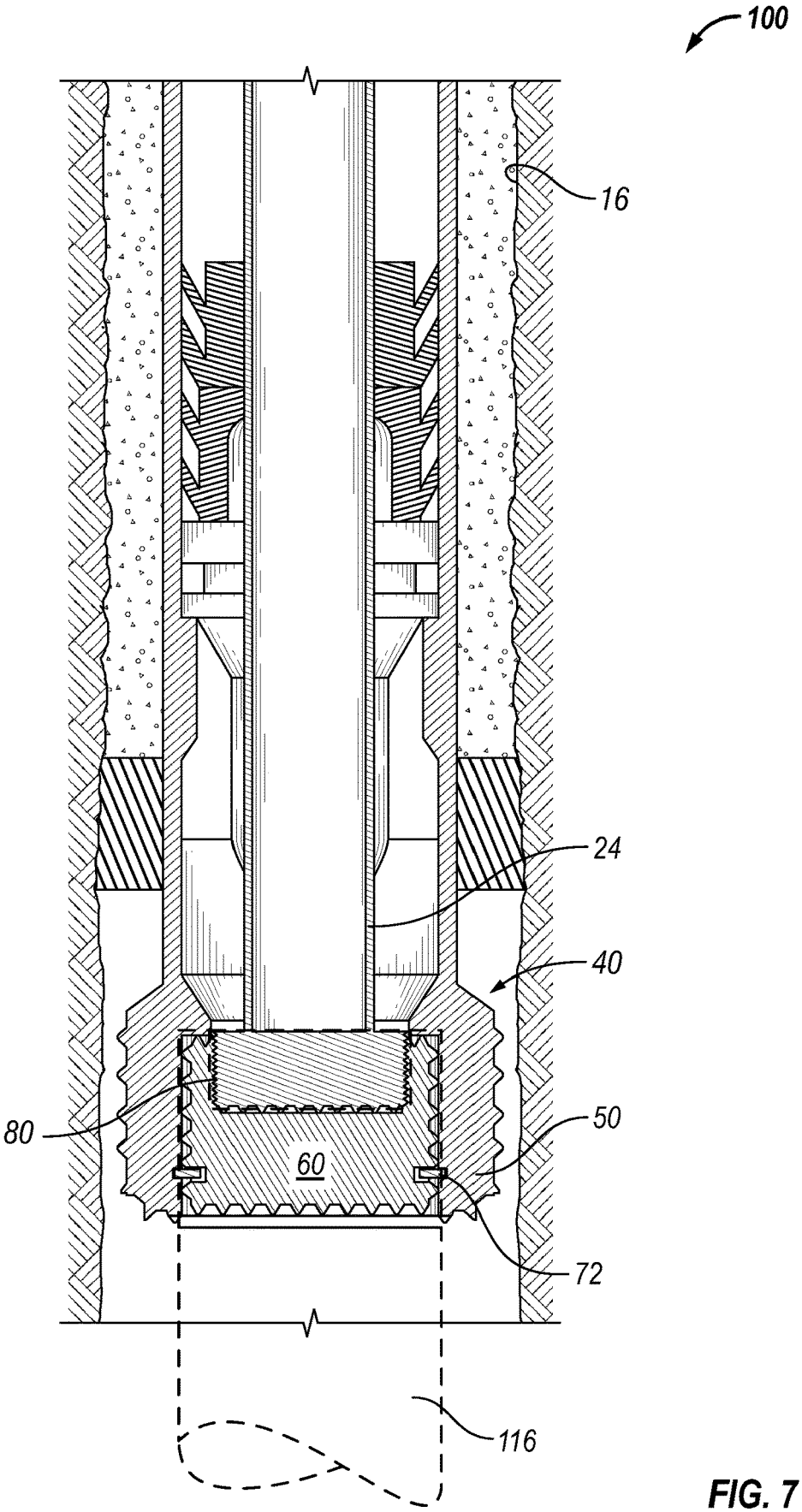
FIG. 7 is a side view of the DWC system after the drive bit has drilled out leftover cementing materials and connected with the child bit.

The nested drill bit assembly, such as described by way of example in FIGS. 1-5 above, may therefore be used to incrementally drill a wellbore with a plurality of drill bits that are initially nested. Advantageously, this allows for drilling to a first depth with a first bit (the parent bit) to a total depth of that first bit, and then to drill past the parent bit with one or more child bits. Notably, the nested drill bit assembly avoids the need to trip out of the wellbore with the first bit before drilling further with the next bit. Further, the system may include a drive bit configured for drilling obstructions prior to connecting with a child bit of the nested drill bit assembly. Although not exclusively, this is particularly useful for a multi-stage cementing operation, whereby each bit of the nested drill bit assembly is driven by a tubular that itself will serve as a casing for the section of the wellbore drilled by that bit. FIGS. 6 and 7 illustrate an example of a drilling with casing (DWC) system and method for use in a multi-stage casing and cementing operation.

FIG. 6 is a side view of a DWC system 100 including a tubular cementing sub, referred to in this configuration as a multi-stage cementer 120. The multi-stage cementer 120 includes a tubular body defined by or otherwise coupled between the nested drill bit assembly 40 and the casing 20. Three cementing plugs are shown by way of example, including a first ("free fall") plug 122, a second ("bottom") plug 124, and a third ("top") plug 126. During a cementing operation, a cement is flowed downhole down the casing 20 and up through an annulus 25 between the casing 20 and wellbore 16, thereby forming a column of cement 130 disposed in the annulus 25. During the cementing operation, the free fall plug 122 may first be disposed downhole into the casing 20 to open up ports 128 on the cementer 120. The bottom plug 124 may then be dropped, followed by the cement flow down the casing 20. The cement may flow through the bottom plug 124, either out the ports 128 in one example or down and out through nozzles on the drill bit assembly 40, and up the annulus 25. The cement, while flowable, may be relatively viscous, adding a component of pressure, and the density and flow of the cement may be carefully controlled to balance pressure in the annulus 25 between pore pressure and fracture pressure. The top plug 126 is disposed on the top of the cement column. When the top plug 126 reaches bottom, it will cause a pressure rise at surface as a positive indication that the cement has substantially all been flowed down the column and up the annulus 25.

FIG. 6 thus represents just one of example the kinds of materials that may be present in the casing 20 after a cementing operation, including various plugs and residual cement. The drive bit 80 has subsequently been lowered on the inner casing 24 after the outer casing 20 that has been cemented, and is poised now to drill out the plugs and residual cement. The drive bit 80 may drill out these materials by rotation of the inner casing 24 while moving the drive bit 80 downward with the inner casing 24. During drilling, a drilling fluid may be flowed downhole through the inner casing 24 and out the drive bit 80 so that the threads or other connector on the drive bit may be relatively clean and free of debris for engagement with the mating threads or other connector on the drive bit 80.

FIG. 7 is a side view of the DWC system 100 after the drive bit 80 has drilled out leftover cementing materials and connected with the child bit 60. At this point, the inner tubular 24 may be used to separate the child bit 60 from the parent bit 50 such as by pushing down with the inner tubular 24 to shear the shear pins 72. Then, the inner tubular 24 may drive rotation of the drive bit 80 and connected child bit 60 to drill beyond the parent bit to form the next wellbore segment 116 beyond the wellbore 16 previously formed by the parent bit 50 and child bit 40 of the nested drill bit assembly 40.

Figure 8:
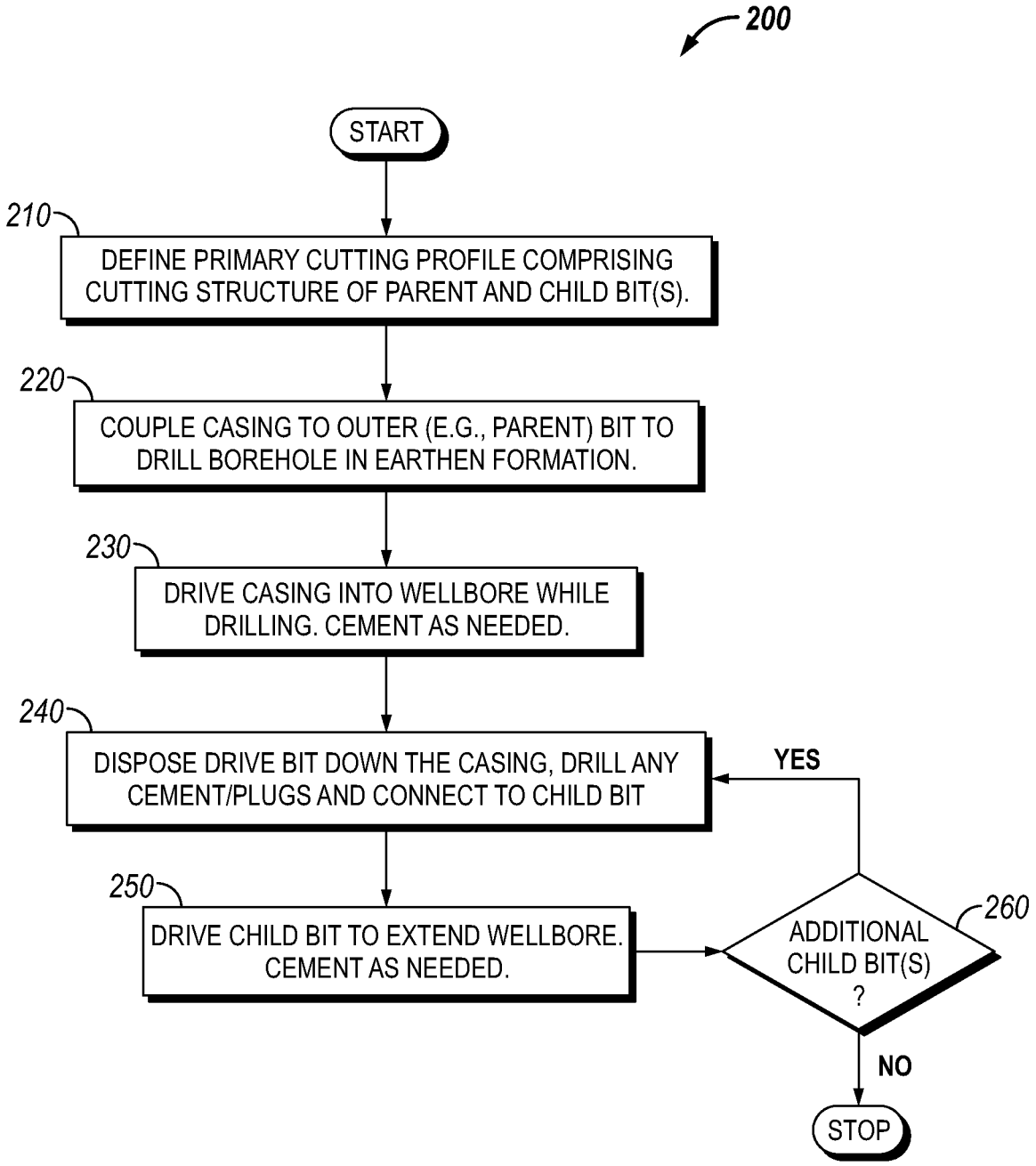
FIG. 8 is a flowchart outlining a method of drilling and casing a well using a nested drill bit assembly.

FIG. 8 is a flowchart 200 outlining a method of drilling and casing a well using a nested drill bit assembly. The method may involve multi-stage cementing, wherein wellbore segments are consecutively drilled using respective drill bits of a nested drill bit assembly, then cased and cemented. The method may be performed with any of the foregoing systems and apparatus, or another system or apparatus within the scope of this disclosure. A first step 210 involves defining a primary cutting profile with a cutting structure on an outermost bit. In a first iteration, the outermost bit is initially a parent bit with one or more child bits initially nested within the parent bit. In step 220, the outermost bit is rotated by rotating a casing coupled to the outermost bit. This rotates the outermost bit and child bit together including the cutting profile collectively defined thereby, to drill a wellbore in an earthen formation. Step 230 is to drive the casing into the wellbore as that wellbore segment is drilled to a first depth, and cementing the casing in place as needed.

In step 240, after drilling to a first depth with the casing and parent drill bit, a driver is disposed the casing on an inner tubular (e.g., another casing) and connected to the child bit. The drive bit may be used to drill out any cement plug and other materials above the child drill bit before connecting the drive bit to the child drill bit. In step 250, the drive bit is used to drive rotation of the child drill bit to further drill the earthen formation with the child drill bit to a further depth. After reaching the further depth, additional cement may be flowed downhole through the inner casing and up into an annulus between the inner casing and the wellbore.

In some examples there may be one or more additional child bits to successively drill to further depths. If one or more additional child bits are included as per decisional step 260, the method returns to step 240, whereby a drive bit is disposed downhole on another tubular, e.g., another casing or just drill pipe. The casing or other tubular in each iteration may be progressively smaller in order to fit within the most recently drilled section. Again, the drive bit may be coupled to the next child bit, and driven to extent the wellbore as per step 250. The flowchart contemplates the use of multiple child bits and multiple casing steps. However, the drilling through cement or cement plugs may only occur one time in some drilling while casing scenarios. Also, rather than including additional child bits, in some drilling scenarios, the drilling may instead continue with a conventional bit through the borehole created by the child bit.

Accordingly, the present disclosure provides a nested drill bit assembly that allows for incrementally drilling each of a plurality of wellbore sections with corresponding bits of the nested drill bit assembly. The methods, systems, and tools may include any of the various features disclosed herein, including one or more of the following statements.

Statement 1. A drilling apparatus for drilling a wellbore, comprising: a parent drill bit including a parent bit body securable to a casing for driving rotation of the parent drill bit with the casing and a parent cutting structure secured to the parent bit body; a child drill bit initially nested within the parent drill bit and including a child bit body releasably coupled to the parent bit body and a child cutting structure secured to the child bit body; and a driver drill bit configured for lowering into the casing and a connector for connecting the driver drill bit to the child drill bit to drive rotation of the child drill bit with respect to the parent drill bit.

Statement 2. The drilling apparatus of Statement 1, wherein at least a portion of the parent cutting structure together with at least a first portion of the child cutting structure define a contiguous primary cutting profile configured for drilling an earthen formation while the child bit body is coupled to the parent bit body.

Statement 3. The drilling apparatus of Statement 2, wherein a second portion of the child cutting structure is positioned interior to the parent bit body when the child drill bit is nested within the parent drill bit, and wherein the second portion of the child cutting structure is exposed for further drilling the earthen formation when the child drill bit is moved out of the parent drill bit.

Statement 4. The drilling apparatus of any of Statements 1 to 3, further comprising: a shoulder interior to the parent bit body that initially blocks movement of the child bit body upward out of the parent bit body; and wherein the child cutting structure comprises a rear-facing cutting structure portion configured to drill out the shoulder to subsequently allow the child bit body to be retrieved axially up out of the parent bit body.

Statement 5. The drilling apparatus of any of Statements 1 to 4, further comprising:

a one-way transmission operatively coupling the parent and child drill bits allowing the parent drill bit to transfer torque to the child drill bit in one rotational direction and not in an opposing rotational direction.

Statement 6. The drilling apparatus of Statement 5, wherein the one-way transmission comprises a ratcheting mechanism disposed between the parent drill bit and the child drill bit.

Statement 7. The drilling apparatus of any of Statements 1 to 6, wherein the child bit body is releasably coupled to the parent bit body by a shear member disposed in an annular channel defined by one or both of the parent drill bit and the child drill bit, thereby limiting relative axial movement but allowing relative rotation between the parent bit body and the child bit body.

Statement 8. The drilling apparatus of any of Statements 1 to 7, further comprising: a second child drill bit initially nested within the child drill bit and including a second child bit body releasably coupled to the child bit body and a second child cutting structure secured to the second child bit body.

Statement 9. The drilling apparatus of any of Statements 1 to 8, wherein the connector for connecting the driver drill bit to the child drill bit comprises a threaded member on the child drill bit and a threaded member on the driver drill bit configured to threadedly connect to the threaded member on the child drill bit.

Statement 10. The drilling apparatus of any of Statements 1 to 9, further comprising a cementing sub defining a passageway for allowing cement to flow through during a cementing operation to cement the casing in the wellbore, and wherein the driver bit includes a driver cutting structure configured to drill out a cement plug positioned above the child drill bit as a result of the cementing operation prior to connecting to the child drill bit.

Statement 11. A method of drilling and casing a well, comprising: defining a primary cutting profile comprising a parent cutting structure on a parent drill bit and a child cutting structure on a child drill bit initially nested within the parent drill bit; rotating the primary cutting profile, including the parent and child cutting structures together, by rotating a casing coupled to the parent drill bit to drill a wellbore in an earthen formation; driving the casing into the wellbore as the wellbore is drilled; after drilling to a first depth with the casing and parent drill bit, lowering a driver drill bit down the casing and connecting the driver drill bit to the child drill bit; and driving rotation of the child drill bit with the driver drill bit to further drill the earthen formation with the child drill bit to a second depth beyond the first depth.

Statement 12. The method of Statement 11, further comprising: after reaching the first depth, flowing a cement downhole through the casing and up into an annulus between the casing and the wellbore; and rotating the driver drill bit to drill out a cement plug above the child drill bit before connecting the driver drill bit to the child drill bit.

Statement 13. The method of Statement 12, further comprising: coupling an inner casing to the driver drill bit and rotating the inner casing to perform the step of driving the rotation of the child drill bit with the driver drill bit; and after reaching the second depth, flowing additional cement downhole through the inner casing and up into an annulus between the inner casing and the wellbore.

Statement 14. The method of any of Statements 11 to 13, further comprising: initially coupling the child drill bit to the parent drill bit with a shear member prior to drilling to the first depth; and applying force to the drive bit to shear the shear member before drilling with the child drill bit.

Statement 15. The method of any of Statements 11 to 14, further comprising: initially blocking movement of the child drill bit axially up out of the parent drill bit with a shoulder interior to the parent bit body; and subsequently using a rear-facing cutting structure on the child drill bit to drill out the shoulder to allow the child bit body to be retrieved axially up out of the parent bit body.

Statement 16. A drilling while casing (DWC) system, comprising: a nested drill bit assembly comprising a parent drill bit having a parent cutting structure secured to a parent bit body and a child drill bit nested within the parent bit body and having a child cutting structure secured to a child bit body; a casing securable to the parent bit body and rotatable for driving rotation of the parent bit body for drilling a first wellbore section into an earthen formation and advancing the casing into the wellbore as the wellbore is drilled; and a driver drill bit configured for lowering into the casing and connectable to the child drill bit to drive rotation of the child drill bit with respect to the parent drill bit to drill a second wellbore section beyond the parent drill bit.

Statement 17. The DWC system of Statement 16, wherein the parent cutting structure together with the child cutting structure form a contiguous primary cutting profile for drilling an earthen formation.

Statement 18. The DWC system of Statement 16 or 17, further comprising: a cementer sub coupled between the nested drill bit assembly and the casing; one or more cement plugs disposable above the nested drill bit assembly to facilitate flow of a cement down the casing an up an annulus between the casing and the wellbore; and wherein the driver drill bit includes a driver cutting structure for drilling out the one or more cement plugs before connecting to the child drill bit.

Statement 19. The DWC system of any of Statements 16 to 18, further comprising: an inner casing disposable in the casing for driving rotation of the driver drill bit and advancing the inner casing into the second wellbore section.

Statement 20. The DWC system of any of Statements 16 to 19, further comprising: a one-way transmission operatively coupled between the parent drill bit and the child drill bit, the one-way transmission configured for allowing the transfer of torque from the parent bit to the child bit in a drilling rotational direction and for relative rotation between the parent drill bit and the child drill bit in an opposite rotational direction.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A drilling apparatus for drilling a wellbore, comprising:

a parent drill bit including a parent bit body securable to a casing for driving rotation of the parent drill bit with the casing and a parent cutting structure secured to the parent bit body;

a child drill bit initially nested within the parent drill bit and including a child bit body releasably coupled to the parent bit body and a child cutting structure secured to the child bit body; and a driver drill bit configured for lowering into the casing and a connector for connecting the driver drill bit to the child drill bit to drive rotation of the child drill bit with respect to the parent drill bit.

2. The drilling apparatus of claim 1, wherein at least a portion of the parent cutting structure together with at least a first portion of the child cutting structure define a contiguous primary cutting profile configured for drilling an earthen formation while the child bit body is coupled to the parent bit body.

3. The drilling apparatus of claim 2, wherein a second portion of the child cutting structure is positioned interior to the parent bit body when the child drill bit is nested within the parent drill bit, and wherein the second portion of the child cutting structure is exposed for further drilling the earthen formation when the child drill bit is moved out of the parent drill bit.

4. The drilling apparatus of claim 1, further comprising:

a shoulder interior to the parent bit body that initially blocks movement of the child bit body upward out of the parent bit body; and wherein the child cutting structure comprises a rear-facing cutting structure portion configured to drill out the shoulder to subsequently allow the child bit body to be retrieved axially up out of the parent bit body.

5. The drilling apparatus of claim 1, further comprising:

a one-way transmission operatively coupling the parent drill bit and the child drill bit allowing the parent drill bit to transfer torque to the child drill bit in one rotational direction and not in an opposing rotational direction.

6. The drilling apparatus of claim 5, wherein the one-way transmission comprises a ratcheting mechanism disposed between the parent drill bit and the child drill bit.

7. The drilling apparatus of claim 1, wherein the child bit body is releasably coupled to the parent bit body by a shear member disposed in an annular channel defined by one or both of the parent drill bit and the child drill bit, thereby limiting relative axial movement but allowing relative rotation between the parent bit body and the child bit body.

8. The drilling apparatus of claim 1, further comprising:

a second child drill bit initially nested within the child drill bit and including a second child bit body releasably coupled to the child bit body and a second child cutting structure secured to the second child bit body.

9. The drilling apparatus of claim 1, wherein the connector for connecting the driver drill bit to the child drill bit comprises a threaded member on the child drill bit and a threaded member on the driver drill bit configured to threadedly connect to the threaded member on the child drill bit.

10. The drilling apparatus of claim 1, further comprising a cementing sub defining a passageway for allowing cement to flow through during a cementing operation to cement the casing in the wellbore, and wherein the driver bit includes a driver cutting structure configured to drill out a cement plug positioned above the child drill bit as a result of the cementing operation prior to connecting to the child drill bit.

11. A method of drilling and casing a well, comprising:

defining a primary cutting profile comprising a parent cutting structure on a parent drill bit and a child cutting structure on a child drill bit initially nested within the parent drill bit;

rotating the primary cutting profile, including the parent and child cutting structures together, by rotating a casing coupled to the parent drill bit to drill a wellbore in an earthen formation;

driving the casing into the wellbore as the wellbore is drilled;

after drilling to a first depth with the casing and parent drill bit, lowering a driver drill bit down the casing and connecting the driver drill bit to the child drill bit; and driving rotation of the child drill bit with the driver drill bit to further drill the earthen formation with the child drill bit to a second depth beyond the first depth.

12. The method of claim 11, further comprising:

after reaching the first depth, flowing a cement downhole through the casing and up into an annulus between the casing and the wellbore; and rotating the driver drill bit to drill out a cement plug above the child drill bit before connecting the driver drill bit to the child drill bit.

13. The method of claim 12, further comprising:

coupling an inner casing to the driver drill bit and rotating the inner casing to perform the step of driving the rotation of the child drill bit with the driver drill bit; and after reaching the second depth, flowing additional cement downhole through the inner casing and up into an annulus between the inner casing and the wellbore.

14. The method of claim 11, further comprising:

initially coupling the child drill bit to the parent drill bit with a shear member prior to drilling to the first depth; and applying force to the drive bit to shear the shear member before drilling with the child drill bit.

15. The method of claim 11, further comprising:

initially blocking movement of the child drill bit axially up out of the parent drill bit with a shoulder interior to the parent bit body; and subsequently using a rear-facing cutting structure on the child drill bit to drill out the shoulder to allow the child bit body to be retrieved axially up out of the parent bit body.

16. A drilling while casing (DWC) system, comprising:

a nested drill bit assembly comprising a parent drill bit having a parent cutting structure secured to a parent bit body and a child drill bit nested within the parent bit body and having a child cutting structure secured to a child bit body;

a casing securable to the parent bit body and rotatable for driving rotation of the parent bit body for drilling a first wellbore section into an earthen formation and advancing the casing into the wellbore as the wellbore is drilled; and a driver drill bit configured for lowering into the casing and connectable to the child drill bit to drive rotation of the child drill bit with respect to the parent drill bit to drill a second wellbore section beyond the parent drill bit.

17. The DWC system of claim 16, wherein the parent cutting structure together with the child cutting structure form a contiguous primary cutting profile for drilling an earthen formation.

18. The DWC system of claim 16, further comprising:

a cementer sub coupled between the nested drill bit assembly and the casing;

one or more cement plugs disposable above the nested drill bit assembly to facilitate flow of a cement down the casing an up an annulus between the casing and the wellbore; and wherein the driver drill bit includes a driver cutting structure for drilling out the one or more cement plugs before connecting to the child drill bit.

19. The DWC system of claim 16, further comprising:

an inner casing disposable in the casing for driving rotation of the driver drill bit and advancing the inner casing into the second wellbore section.

20. The DWC system of claim 16, further comprising:

a one-way transmission operatively coupled between the parent drill bit and the child drill bit, the one-way transmission configured for allowing the transfer of torque from the parent bit to the child bit in a drilling rotational direction and for relative rotation between the parent drill bit and the child drill bit in an opposite rotational direction.

* * * * *